US005643010A

United States Patent [19]

Wu

[11] Patent Number: 5,643,010

[45] Date of Patent: Jul. 1, 1997

[54] HIGH PIN DENSITY ELECTRICAL CONNECTOR

[75] Inventor: Kun-Tsan Wu, Tu-Chen, Taiwan

[73] Assignee: Hon Hai Precision Ind. Co., Ltd., Taiwan

[21] Appl. No.: 590,520

[22] Filed: Dec. 12, 1995

[51] Int. Cl.[6] ..... H01R 13/514

[52] U.S. Cl. ..... 439/598; 439/79; 439/678

[58] Field of Search ..... 439/78, 79, 598, 439/741, 751, 851, 861, 752, 634, 678

[56] References Cited

U.S. PATENT DOCUMENTS

| | | | |
|---|---|---|---|
| 4,418,972 | 12/1983 | Benasutti | 439/686 |
| 4,871,320 | 10/1989 | Mouissie | 439/598 |
| 4,917,614 | 4/1990 | Kikuchi et al. | 439/83 |
| 4,932,902 | 6/1990 | Crane, Jr. | 439/627 |
| 5,181,862 | 1/1993 | Hawk et al. | 439/752 |
| 5,378,170 | 1/1995 | Abe et al. | 439/751 |

*Primary Examiner*—Neil Abrams
*Assistant Examiner*—Tho D. Ta

[57] ABSTRACT

A high pin density electrical connector includes an insulation body having a first surface and a second surface, a metal shield mounted to the first surface of the insulation body, having a plate portion and a shaped frame mounted to the plate portion to define a circumferentially surrounded space and a plurality of pin members. The insulation body has formed on the second surface thereof two cavities each having two circumferences along which a plurality of pin receiving holes are formed to extend from the first surface to the cavities. A pin support member having two edges along which slots are formed is snugly received within each of the cavities. The pin members are first received and supported within the slots of the pin support members and then extend through the pin receiving holes to be retained therein so as to have a leading section of each of the pin members extend into the surrounded space of the shield.

12 Claims, 9 Drawing Sheets

HIGH PIN DENSITY ELECTRICAL CONNECTOR

FIELD OF THE INVENTION

The present invention relates generally to an electrical connector and in particular to an electrical connector having a compact, concise and dense pin arrangement particularly suitable for use in miniature computerized office machines.

BACKGROUND OF THE INVENTION

Conventionally, the communication connection between a computer and peripheral devices is done via the so called D-type connector which has a plurality of pins with a spacing between adjacent pins approximately equal to 2.54 mm. Such an electrical connector is the most widely used electrical connector for computers and associated devices. Due to the fact that the pins of this connector are arranged in a sparse manner (or referred to as low pin density), the connector occupies a large surface area on a printed circuit board which the connector engages. Such a low pin density connector is quite obviously not suitable for use in miniature office machines, such as notebook computer, which requires the pins of the connector to be arranged in a more compact and denser manner.

Further, in order to have a high density arrangement of the pins for use in a miniature office machine, the number of pins to be accommodated within a given area is increased, as compared to the conventional connector. This causes a greater fitting force acting upon the pin receiving holes of an insulation body of the connector during assembly. Since the partition wall between two adjacent ones of the pin receiving holes is quite thin and such a greater force may directly destruct the partition and lead in flaw products.

Solving such a problem by simply reducing the size of the pins or increasing the partition wall thickness between two adjacent pin holes is not feasible, because the former reduces the contact area that is available on the pin terminal and may thus cause signal transfer problem and the latter increases the overall surface area occupied by the electrical connector and thus not suitable for miniature office machines.

It is therefore desirable to provide a high pin density electrical connector structure which overcomes the problems.

SUMMARY OF THE INVENTION

The principal object of the present invention is to provide a high pin density electrical connector which comprises a compact, concise and dense arrangement of pins, particularly suitable for use in miniature office machines, the pins being engaged by and supported on a pin support member which is received within a cavity formed on an insulation body of the connector to firmly secure the pins on the insulation body without physical damage to the insulation body. In other words, the pins are first retained on a separate member (the pin support member) and then the separate member, together with the pins secured thereon, is secured to the insulation body. Such a design provides flexibility and effectiveness in the assembly of electrical connector.

It is another object of the present invention to provide an electrical connector which can be used in either a vertical connection manner or a horizontal connection manner with mated coupling devices so as to provide options in how to use the connector.

It is a further object of the present invention to provide an electrical connector incorporating retainer members which guides the assembly of the electrical connector in a more effective manner and provides a better capability to retain parts of the electrical connector together.

Thus, in accordance with the present invention, a high pin density electrical connector with a plurality of pins retained thereon is provided, comprising a separated pin support member having two edges along which a plurality of slots are formed to each engage and support one of the pins, the pin support member being secured to the insulation body to have the pins that are supported on the pin support member extend through pin receiving holes formed on the insulation body.

To secure the pin support member to the insulation body, the insulation body is provided with a cavity shaped corresponding to the pin support member to snugly receive and retain the pin support member therein to have leading sections of the pins, that are supported on the pin support member and extending through pin receiving holes formed on the insulation body, partially project out of the insulation body.

In accordance with a further aspect of the present invention, the slots that are formed on the pin support member to receive and support the pins have a raised stop formed in each of the slots to engage a notch formed on the leading section of the pins and thus preventing the pin from moving relative to the pin support member.

In accordance with a further aspect of the present invention, the pin support member is provided with retaining blocks to engage retaining slots formed inside the cavity so as to retain the pin support member within the cavity. The retaining blocks are each provided with a slope to cooperate with an inclined camming surface formed inside the cavity for helping moving the retaining blocks into the retaining slots.

The electrical connector in accordance with the present invention is further characterized in that the insulation body has two spaced recesses formed thereon to each receive therein a retainer which allows the electrical connector to be used in either a horizontal style or a vertical style.

BRIEF DESCRIPTION OF THE DRAWINGS

The present invention will be better understood from the following description of an illustrative but non-limitative preferred embodiment of the present invention, with reference to the attached drawings, wherein:

FIG. 4(A) is a partial perspective enlarged view of the pin member.

FIG. 4(B) is a perspective enlarged view of the pin support member.

DETAILED DESCRIPTION OF THE PREFERRED EMBODIMENT

Figure 1:
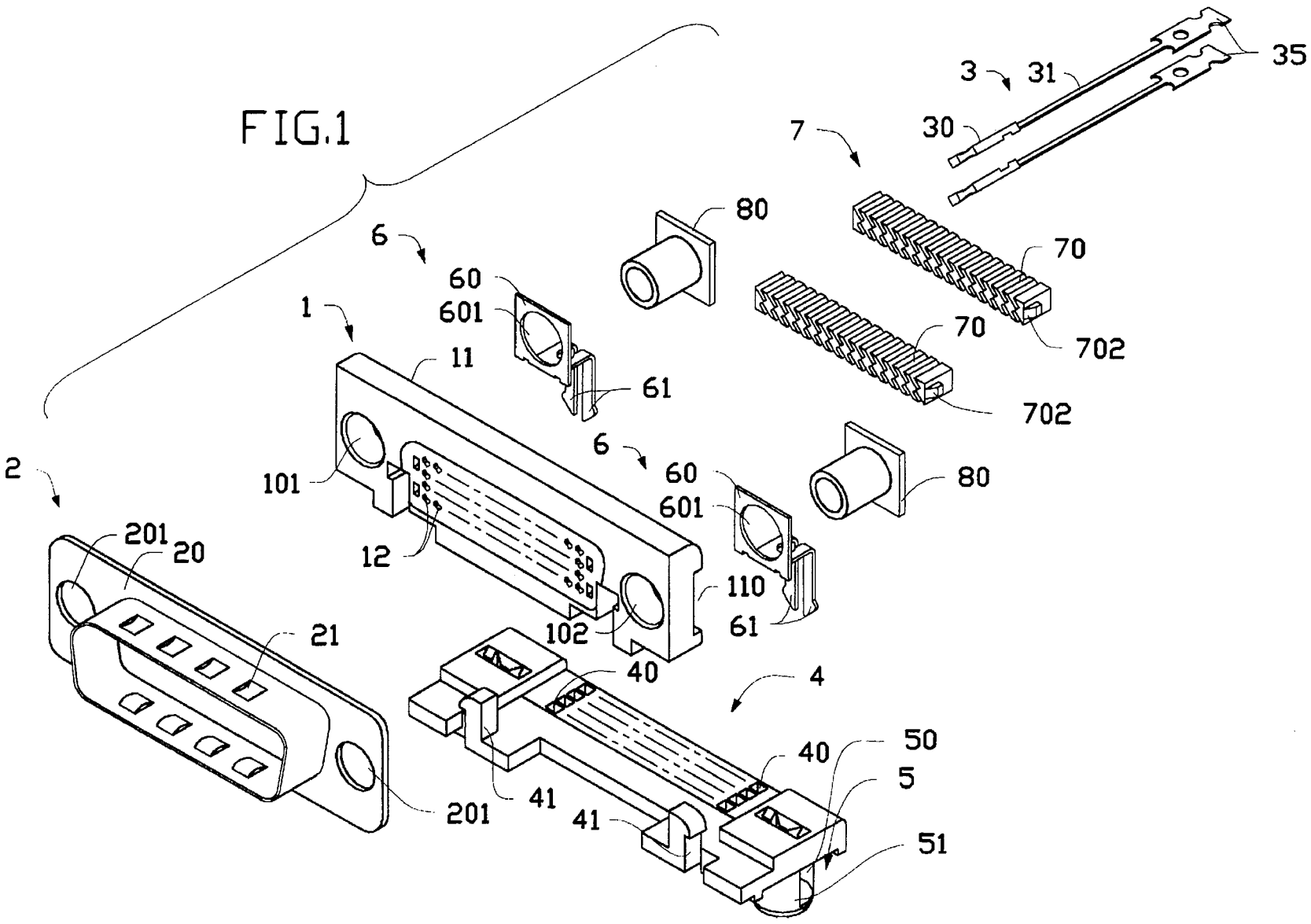
FIG. 1 is an exploded perspective view showing a high pin density electrical connector constructed in accordance with the present invention.

With reference to the drawings and in particular FIG. 1, wherein a high pin density electrical connector constructed in accordance with the present invention is shown, the high pin density electrical connector, as illustrated in FIG. 1, comprises an insulation body 1, a shield 2, preferably made of a metal, a plurality of conductive pin members 3 (only two being shown in the drawings for simplicity), a pin leg securing device 4 with a guiding member 5, two retainers 6 and two pin support members 7. The insulation body 1 is in general a plate having a first surface 10, located on the front side as viewed in FIG. 1, with a hole 101 or 102 formed on each of two opposite lateral sides thereof for receiving and retaining therein one of the retainers 6 which comprise a pair of retaining legs 61 (to be described in detail hereinafter) for securing the high pin density electrical connector to a printed circuit board (not shown).

The insulation body 1 further has a second surface 11, opposite to the first surface 10 thereof and thus located on the rear side as viewed in FIG. 1. The second surface 11 of the insulation body 1 has formed on each of two opposite lateral sides thereof a recess 110, associated with one of the hole 101 and 102 to provide initial positioning of the respective retainer 6.

It is to be noted that since each of the recess 110 has no raised plateau which may be found in some conventional electrical connectors to limit extension of the retaining legs 61, the direction along which the retaining legs 61 of the retainer 6 extend may be set to be either vertical or horizontal without any limitation. This allows the electrical connector to be coupled to a mated member in either a vertical or horizontal manner.

Figure 5:
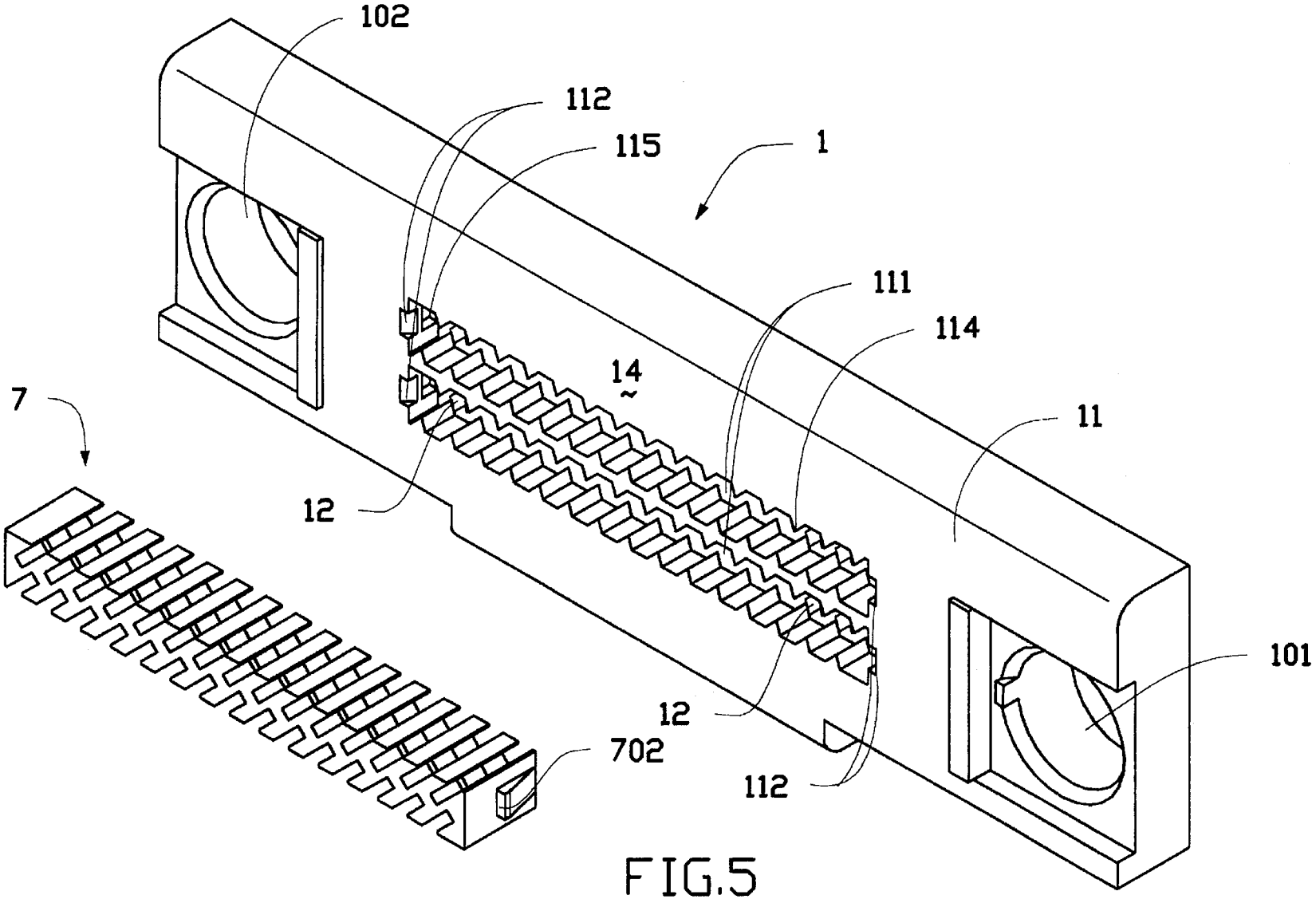
FIG. 5 is a perspective rear view of the insulation body adapted in the high pin density electrical connector, showing the second surface thereof, together with one pin support member separated therefrom.
Figure 6:
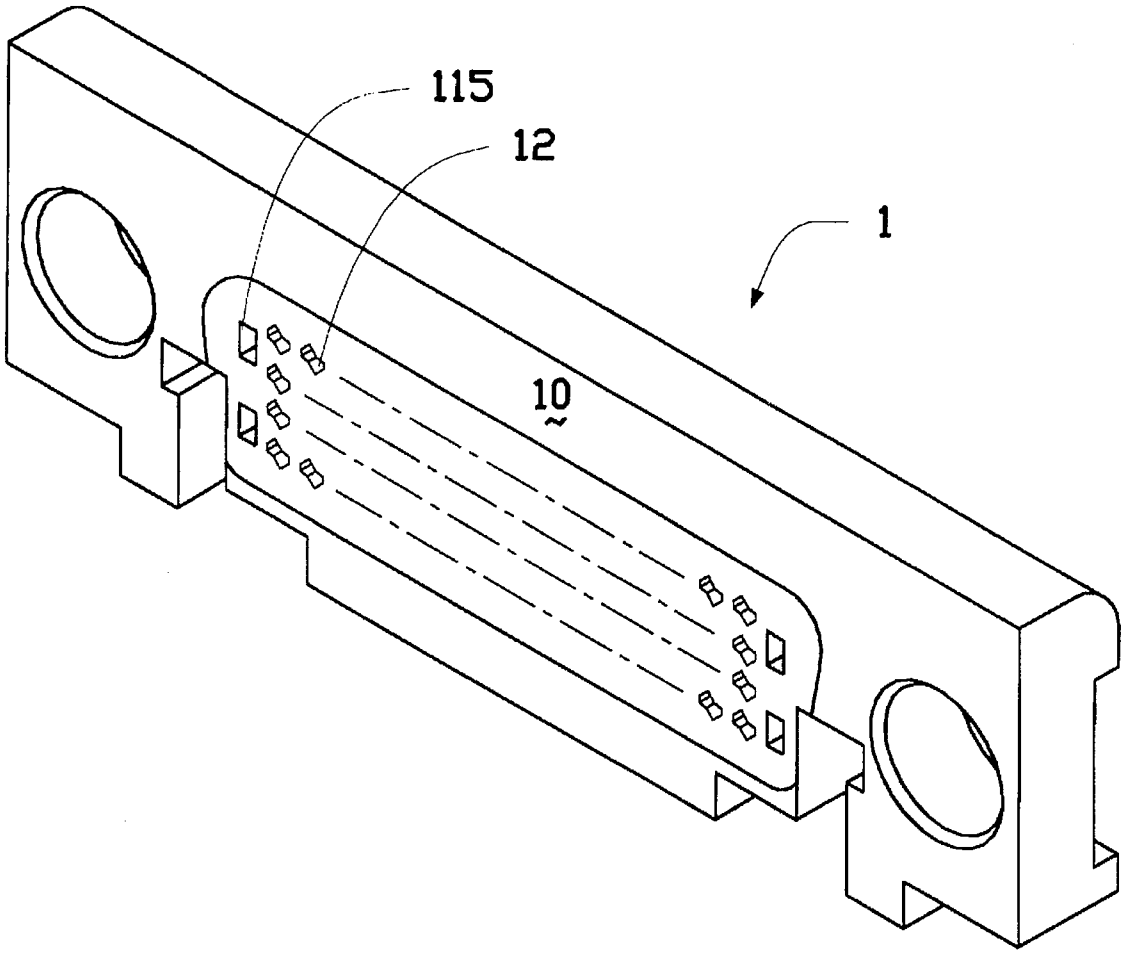
FIG. 6 is a perspective front view of the insulation body.

The insulation body 1 has formed on a central portion of the first surface 10 a plurality of pin receiving holes 12 arranged into two pairs of rows. On the second surface 11 of the insulation body 1, two large cavities 111 are formed, each corresponding to one pair of rows of the pin receiving holes 12 and having two circumferences thereof substantially extending along the respective two rows of holes 12, as shown in FIG. 5 so as to allow the pin receiving holes 12 located at the positions within the cavity 111. The cavities 111 have a bottom surface separated from the first surface 10 at a given distance to define a thickness between the bottom surface 113 of the cavities ill and the first surface 10. The pin receiving holes 12 are configured to have a have a cross-section resemble figure "8" (see FIG. 6 )which is inclined relative to an axis connecting the holes 12 of one of the rows and extend from the first surface 10 to the bottom surface 113 of the cavities 111 and thus across the thickness of the insulation body 1 between the bottom of the cavities 111 and the first surface 10, as shown in FIG. 5, in which only some of the pin receiving holes 12 are demonstrated for simplicity. The pin support members 7 are shaped complemental to the cavities 111 and are respectively snugly received within the cavities 111. Each of the pin members 3 is received within and extending through one of the pin receiving holes 12 and supported within a slot 70 formed on the respective pin support member 7. This will be further discussed hereinafter.

Figure 3:
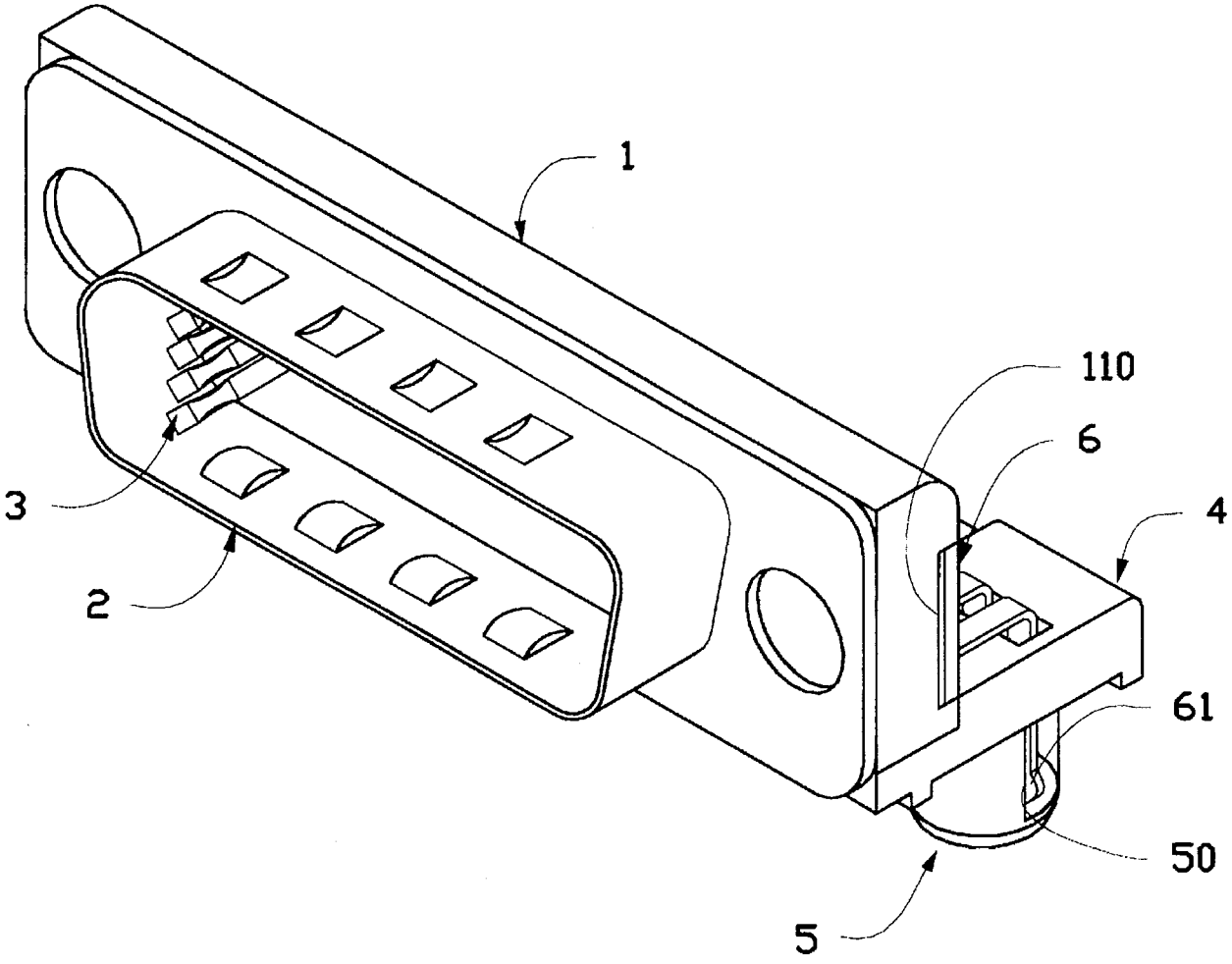
FIG. 3 is a perspective view of the assembled high pin density electrical connector of the present invention.

The shield 2 is preferably made of a metal plate to define a plate portion 20 to be disposed against and thus shield the first surface 10 of the insulation body 1, having an opening with a shaped frame 21 secured thereto, forming a circumferential wall surrounding the opening and defining a space for accommodating leading terminal sections 30 of the pin members 3 therein. The plate portion 20 of the shield 2 has formed thereon two holes 201, each corresponding to one of the holes 101 and 102 of the insulation body 1 to allow a fastener 80 to extend through both the hole 201 and the hole 101 (or 102) of the insulation body 1 for securing the shield 2 on the first surface 10 of the insulation body 1. The shield 2 is so secured to the insulation body 1 that the opening of the plate portion 20 of the shield 2 and the space surrounded and defined by the shaped frame 21 aligned with the central portion of the first surface 10 of the insulation body 1 on which the pin receiving holes 12 are formed whereby the pin members 3 that extend through the pin receiving holes 12 have the leading terminal sections 30 thereof located within the space defined by the shaped frame 21 of the shield 2, as shown in FIG. 3.

Figure 4:
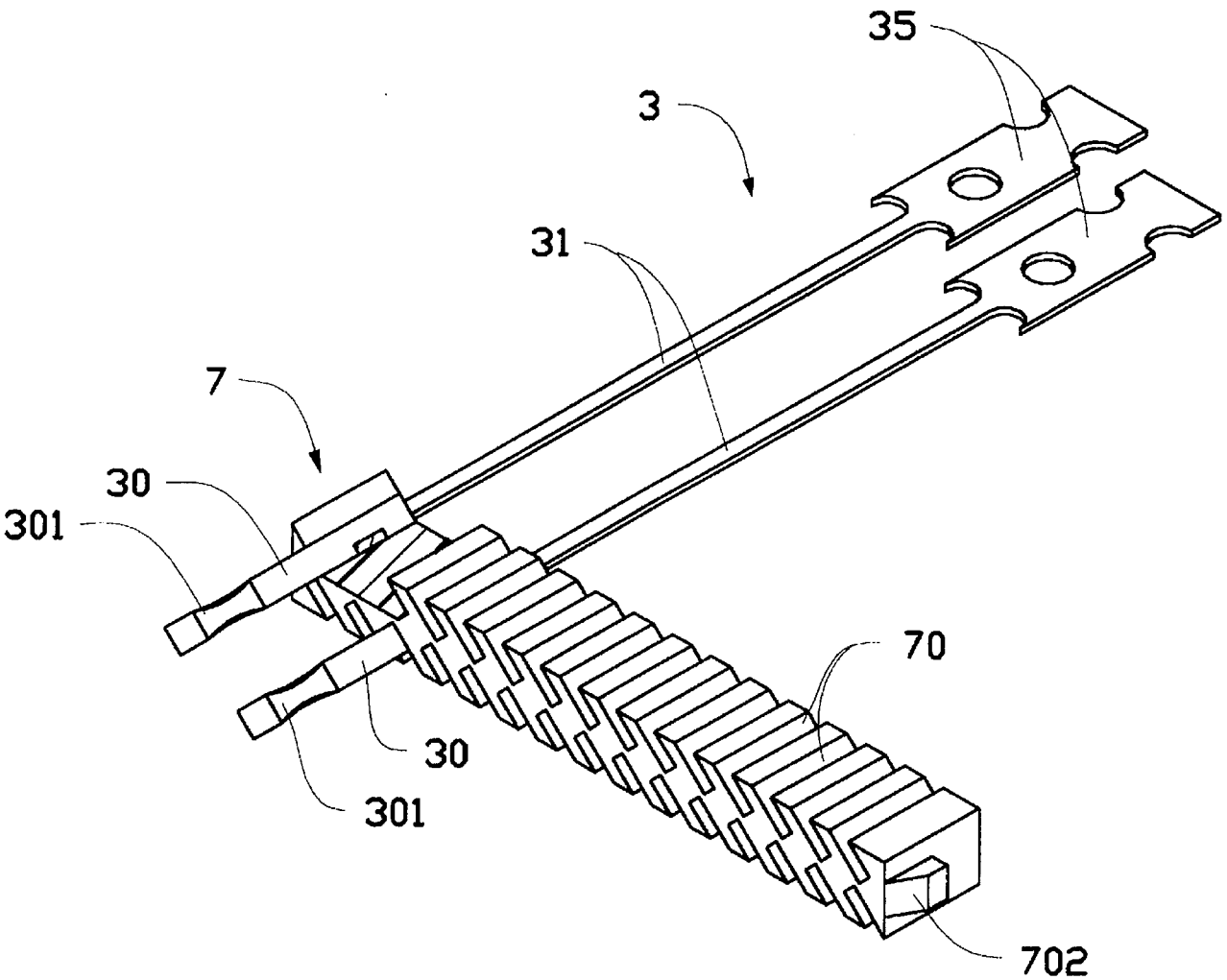
FIG. 4 is a perspective view showing two of the pin members adapted in the high pin density electrical connector of the present invention with a residual blank material remained on the rear end thereof to be cut off mounted on the pin support member.
Figure 4:
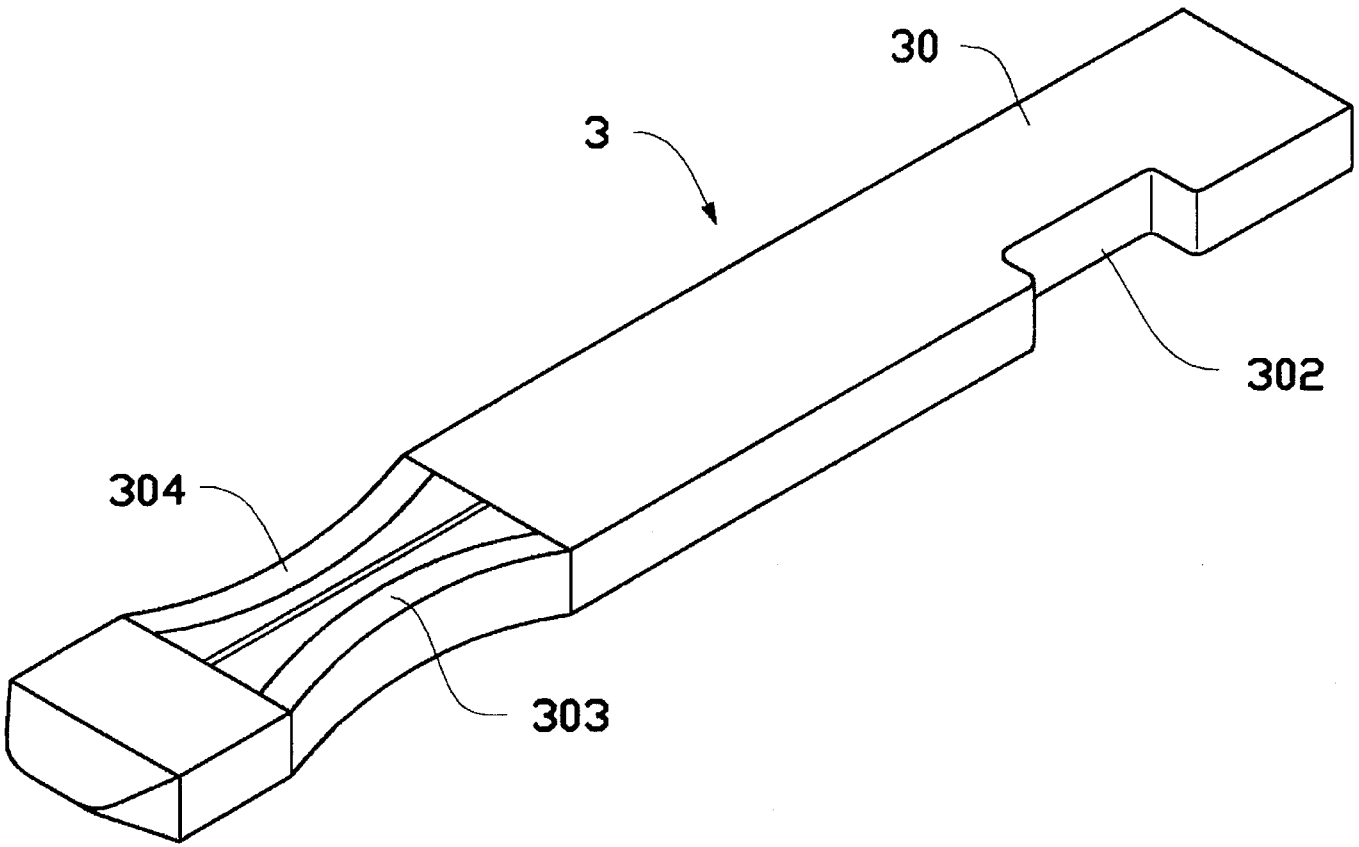
Figure 4:
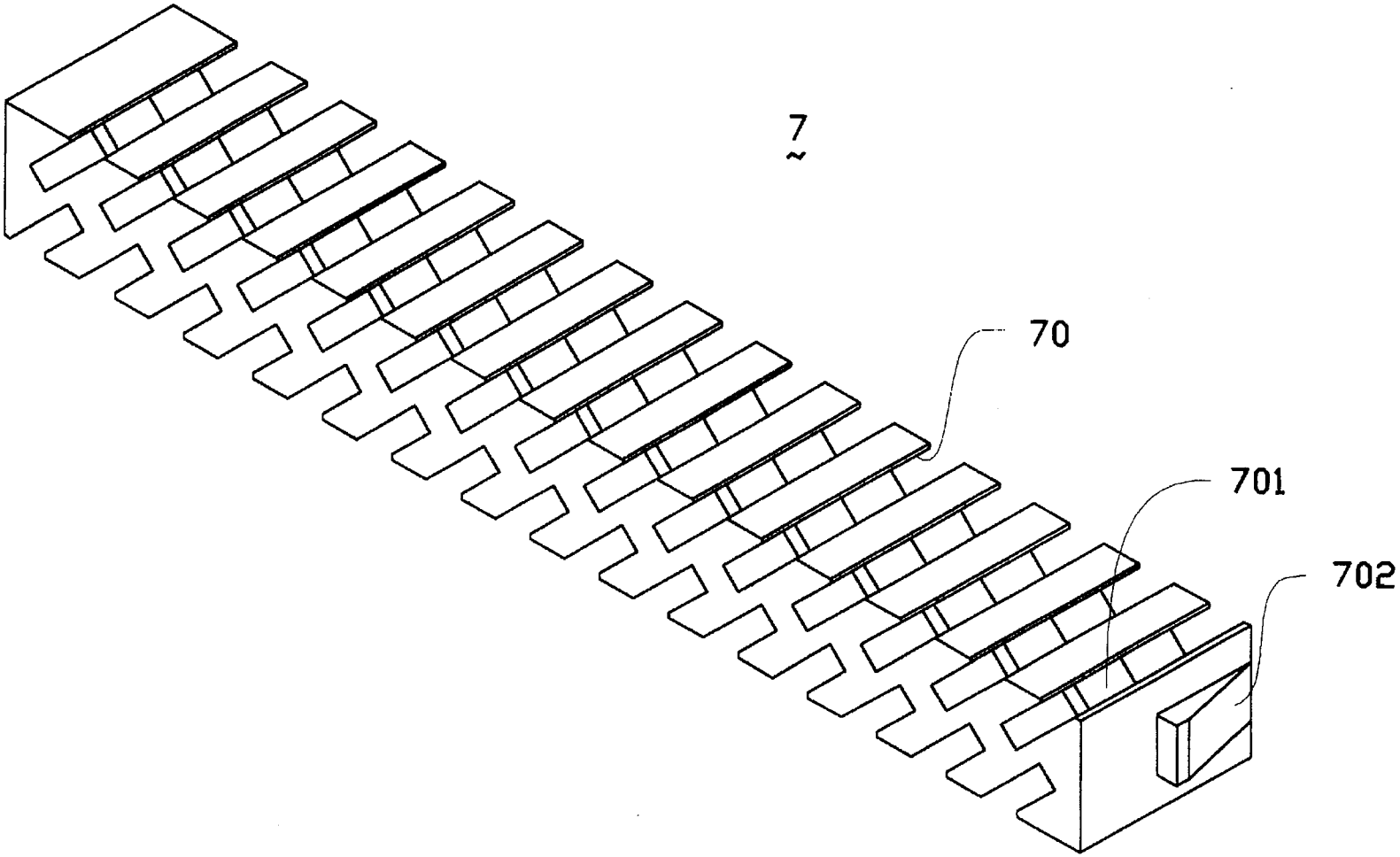
Figure 7:
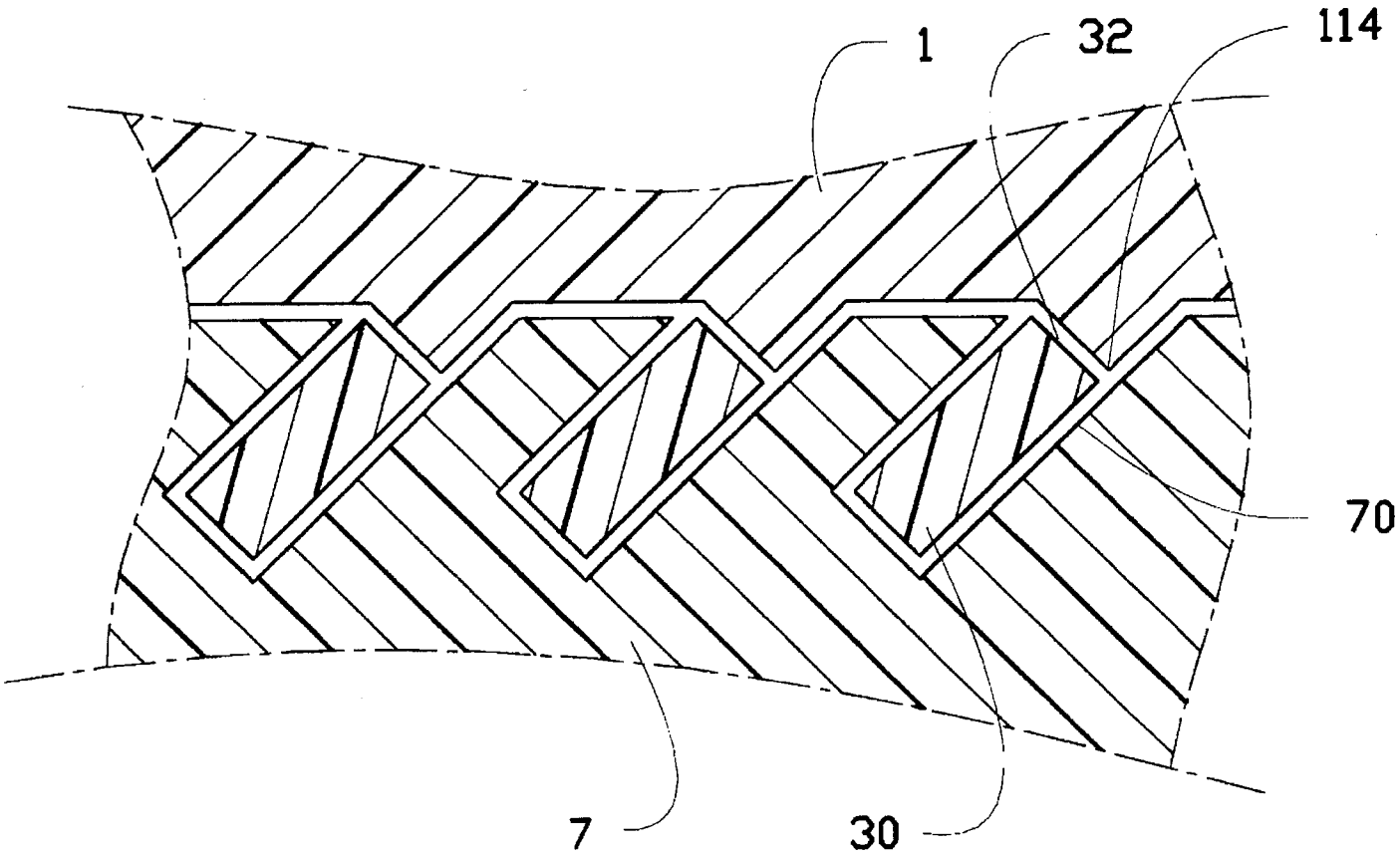
FIG. 7 is a partial cross-sectional view of the insulation body ,the support member, and the pin member to show the relationship therebetween

FIG. 4 shows an enlarged perspective view of one of the pin support members 7 with pin members 3 supported thereon. Also to FIGS. 4(A) and 4(B) The pin support members 7, as discussed previous, are shaped corresponding to the cavities 111 of the insulation body 1 in order to be snugly received within the cavities 111. Each of the support members 7 has a plurality of slots 70 spaced along two edges thereof, which edges correspond to the circumferences of the respective cavity 111 to have the slots 70 each in registration with one of the pin receiving holes 12 of the insulation body 1. The slots 70 of the pin support members 7 are oriented in an inclined manner to correspond the inclination of the figure "8" configured pin receiving holes 12. Further, each of the slots 70 comprises a raised stop 701 formed therein. It can be understood that when the support member 7 is received in the corresponding cavity 111, the peak portions 114 of the circumferences of the cavity 111 may properly project into the ends of the corresponding slots 70, respectively as shown in FIG. 7.

Although in FIG. 4, only two pin members 3 are illustrated, it is understood that these two pin members 3 are for demonstration only and there should be as many pin members 3 as the slots 70 and each of the slots 70 may have a pin member 3 received and supported therein.

In FIG. 4, it is seen that each of the pin members 3 has a residual blank material 35 remaining attached to a tailing section 31 of the pin member 3 that is connected along a longitudinal direction to the leading section 30. This residual material 35 will be cut off once the assembly of the electrical connector is completed.

Each of the pin support members 7 has two opposite retaining blocks 702 formed thereon and correspondingly each of the cavities 111 has two retaining slots 115 to engage the retaining blocks 702 for retaining the pin support members 7 within the cavities 111. Further, each of the cavities 111 comprises two opposite inclined camming surfaces 112 located adjacent the retaining slots of the cavity 111 and close to the opening edge of the cavity 111 so as to cooperate with slopes formed on the retaining blocks 702 to help moving the retaining blocks 702 into engagement with the retaining slots 115 of cavity 111.

The pin members 3 comprise a flat, leading terminal section 30 with a reduced waist 301 defined by two opposite arcuate concave sides. As shown in FIG. 4(A), the leading section 30 of the pin member 3 includes an upward bowed right half section 303 and a downward bowed left half section 304 around its front end for compliance with the mating portion of a complementary connector (not shown). The leading section 30 of the pin member 3 also comprises a notch 302 to fit over and engage the stop 701 of the respective slot 70 for constraining the movement of the pin member 3 relative to the pin support member 7 and thus the insulation body 1. The tailing section 31 of each of the pin members 3 that is connected along the longitudinal direction to the leading section 30 defines a pin leg to which the residual material 35 is attached. The pin leg of the tailing section 31 is to be received and retained within one of a plurality of holes 40 formed on the pin leg securing device 4.

In assembly, the pin members 3 are first inserted into the slots 70 of the pin support members 7 with the notches 302 engaging the stops 701. The so assembled pin support members 7 with the pin members 3 supported thereon are then fit into the cavities 111 from the second surface 11 of the insulation body 1 to have the leading sections 30 of the pin members 3 extending through the pin receiving holes 12 and into the space defined by the shaped frame 21 of the shield 2.

Under this situation and referring to FIG. 7, the support member 7 is substantially received in the corresponding cavity 111, and the peak portion 114 of the circumferences of the cavity 111 project into the correspondding slots 70, respectively, for properly engagement with the side edges 32 of the corresponding pin member 3 received in the slots 70, respectively. Therefore, the pin member 3 can not move laterally from the slot 70. In inserting the pin members 3 into the pin receiving holes 12 of the insulation body 1, the leading sections 30 of the pin members 3 are oriented in a slightly inclined manner relative to the axis that connects the pin receiving holes 12 of the respective row to allow the leading sections 30 to be easy to move into the pin receiving holes 12. The, tailing section 31 of each of the pin members 3 that defines the pin leg is then inserted into and secured on an associated hole 40 of the pin leg securing device 4.

The pin leg securing device 4 comprises a plate member made of an insulation material on which the plurality of positioning holes 40 are formed to respectively receive and retain therein the pin leg defined on the tailing section 31 of each of the pin members 3. On a front side of the pin leg securing device 4, a pair of paw members 41 are formed and extending to define a hooked free end to be in engagement with a corresponding shoulder or slot formed on the insulation body 1 so as to secure the pin leg securing device 4 to the insulation body 1.

Further, the plate of the pin leg securing device 4 has formed on each of two lateral sides thereof a guiding member 5 which comprises a cylinder depending from a lower surface of the plate 4, with a through slot 50 which extends completely through the cylinder 51 in a lateral direction to define two lateral openings on a cylindrical outer surface of the guiding member 5. The slot 50 also extends upward to define an upper opening on an upper surface of the plate 4 for the entry of the retaining legs 61 of the respective retainer 6.

The cylinder of each of the guiding members 5 is preferably provided with a chamfer on a free end thereof for guiding the insertion of the cylinders of the guiding members 5 into holes formed on a printed circuit board (not shown) to establish physical connection with the printed circuit board. The electrical connection between the electrical connector and the printed circuit board is provided by the pin legs of the pin members 3.

Each of the retainers 6 that engages the respective recess 110 formed on the second surface 11 of the insulation body 1 is preferably made of a metal of desired elasticity, comprising a plate 60 with a central through hole 601 formed thereon to receive the fastener 80 extending therethrough. The fastener 80, as mentioned above, also extends through the respective hole 101 or 102 of the insulation body 1 and the respective hole 201 of the shield 2 to secure the retainer 6, the insulation body 1 and the shield 2 together, Each of the retainers 6 further comprises a pair of retaining legs 61, each having a hooked free end extending downward into the slot 50 of the respective cylinder of the guiding member 5 through the upper opening of the slot 50 to have the hooked ends of the retaining legs 61 partially protrude out of the slot 50 via the lateral openings of the slot 50. The elasticity of the material that makes the retainer 6 provides the retaining legs 61 with a resiliency which allows the retaining legs 61 to resiliently engage a printed circuit board (not shown) for securing the electrical connector of the present invention to the printed circuit board.

The fastener 80 is preferably a rivet which has an inner-threaded hole to engage a mated coupling member or a corresponding connection member.

Figure 2:
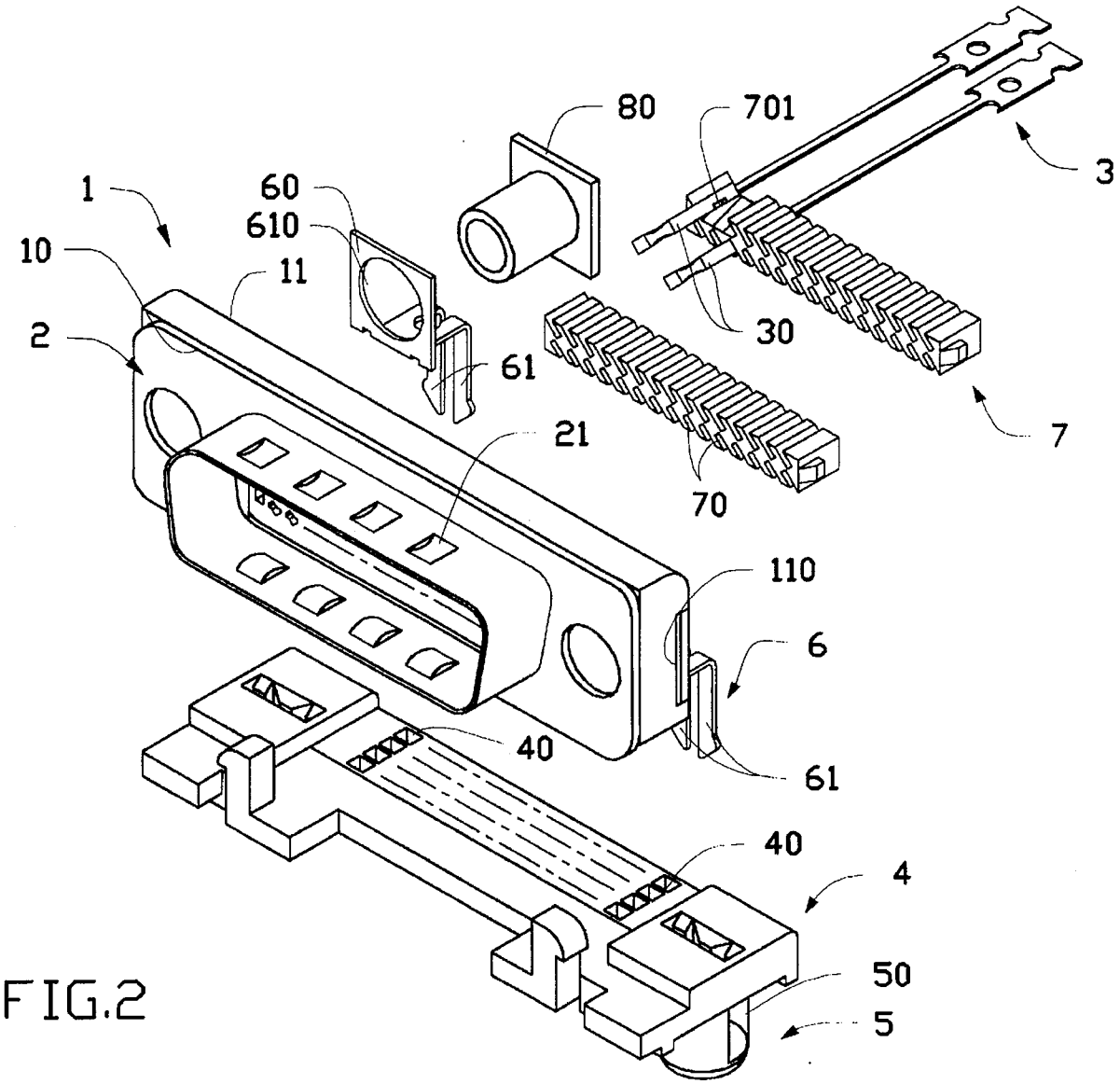
FIG. 2 is a perspective view of the high pin density electrical connector of the present invention, showing the situation where the pin support members and the pin leg securing device are not yet secured to the insulation body and the retainers.

In the whole assembly, the shield 2 is first disposed onto the first surface 10 of the insulation body 1 and the pin members 3 are inserted into the slots 70 of the pin support members 7, as shown in FIG. 2. The pin support members 7 are then inserted into the cavities 111 and pin members 3 fit, in an inclined manner, into the figure "8" configured pin receiving holes 12 of the insulation body 1 to have the leading section 30 thereof extend out of the first surface 10 and into the space defined by shaped frame 21 of the shield 2. The retainers 6 are then respectively disposed into the recesses 110 that are formed on the second surface 11 of the insulation body 1 with the fasteners 80 extending through the holes 601 of the retainers 6, the holes 101 and 102 of the insulation body 1 and the holes 201 of the shield 2 to secure the retainers 6, the insulation body 1 and the shield 2 together.

Thereafter, the pin legs of the pin members 3 are forced to insert into the positioning holes 40 of the pin leg securing device 4 and the retaining legs 61 of the retainers 6 into the slots 50 of the guiding members 5 and further allowing the hooked upper ends of the paw members 41 of the pin leg securing device 4 to engage the corresponding slots of the insulation body 1 to complete the assembly of the pin leg securing device 4 to the insulation body 1, as shown in FIG. 3.

To this point, through the above description, it is understood that due to the use of the separate pin support members 7 and the novel design of the figure "8" configured pin receiving holes 12, the high pin density electrical connector of the present invention provides a compact, concise and dense arrangement of the terminal pins that suits the requirement of the miniature office machines and is capable to retain more pins within a given area without damage to the insulation body 1. Further, the design of the recesses 110 on the second surface 11 of the insulation body 1 provides the options to use the electrical connector of the present invention to be connected in a horizontal manner or a vertical manner.

It is apparent that although the invention has been described in connection with the preferred embodiment, it is contemplated that those skilled in the art may make changes to the preferred embodiment without departing from the scope of the invention as defined in the appended claims.

I claim:

1. An electrical connector comprising:

an insulative body having at least a cavity therein;

at least a pin support member shaped to be complemental to said cavity and adapted to be received in said cavity;

a plurality of spaced slots formed in said pin support member for receiving a corresponding number of pin members therein, respectively;

said insulation body including around said cavity a plurality of engaging means projecting into the corresponding slots of the pin support member, respectively, for substantially abutting against the corresponding pin members in the slots whereby the pin members can not be moved laterally from the slot, and wherein said engaging means are a series of serrated sections formed along a circumference of said cavity in said insulation body.

2. The connector as described in claim 1, wherein each of the slots of the pin support member comprises stop means which comprises a raised stop formed inside each of the slots, and the pin member received within the slot has a notch formed on a leading section thereof to engage the raised stop for preventing the pin member from moving relative to the slot in an axial direction along said leading section of the pin member.

3. The connector as described in claim 1, wherein said cavity has retaining holes formed therein and said pin support member includes retaining blocks formed thereon to engage the retaining holes of the cavity for retaining the pin support member within the cavity.

4. The connector as described in claim 1, wherein a plurality of pin receiving holes extending between and through a first surface and a bottom surface of said cavity for receiving leading sections of the pin members.

5. The connector as described in claim 4, wherein each of said leading sections of the pin members includes an upward bowed half section and a downward bowed half section proximate a front end, and each of the pin receiving holes has an "8"-like cross-sectional configuration.

6. An electrical connector comprising:

an insulation body having a first surface and an opposite second surface, a cavity extending inward from the second surface and terminating before reaching said first surface and forming a bottom surface thereof;

a plurality of pin receiving holes formed between and extending through the first surface of the insulation body and the bottom surface of the cavity;

a pin support member adapted to be latchably received within the cavity wherein said pin support member includes a plurality of slots in alignment with the corresponding pin receiving holes, respectively; and a plurality of pin members each including a leading section wherein said leading section is not only retained within the corresponding slot of the pin support member but also extends through the corresponding pin receiving hole and into a space in front of the first surface, and wherein each of the slots of the pin support member comprises stop means which comprises a raised stop formed inside each of the slots, and the pin member received within the slot has a notch formed on the leading section thereof to engage the raised stop for preventing the pin member from moving relative to the slot in an axial direction along said leading section of the pin member.

7. The connector as described in claim 6, wherein said plural slots are side by side arranged in generally a diagonally inclined manner in the pin support member.

8. The connector as described in claim 6, wherein each of said leading sections of the pin members includes an upward bowed half section and a downward bowed half section proximate a front end, and each of the pin receiving holes has an "8"-like cross-sectional configuration.

9. The connector as described in claim 6, wherein said insulation body includes around said cavity a plurality of engaging means projecting into the corresponding slots of the pin support member, respectively, for substantially abutting against the corresponding pin members in the slots whereby the pin members can not be moved laterally in the slots, respectively.

10. The connector as described in claim 9, wherein said engaging means are a series of serrated sections formed along a circumference of said cavity in said insulation body.

11. An electrical connector comprising:

an insulative body having at least a cavity therein;

at least a pin support member shaped to be complemental to said cavity and adapted to be received in said cavity;

a plurality of spaced slots formed in said pin support member for receiving a corresponding number of pin members therein, respectively;

said insulation body including around said cavity a plurality of engaging means projecting into the corresponding slots of the pin support member, respectively, for substantially abutting against the corresponding pin members in the slots whereby the pin members can not be moved laterally from the slot, and wherein a plurality of pin receiving holes extending between and through a first surface and a bottom surface of said cavity for receiving leading sections of the pin members.

12. An electrical connector comprising:

an insulation body having a first surface and an opposite second surface, a cavity extending inward from the second surface and terminating before reaching said first surface and forming a bottom surface thereof;

a plurality of pin receiving holes formed between and extending through the first surface of the insulation body and the bottom surface of the cavity;

a pin support member adapted to be latchably received within the cavity wherein said pin support member includes a plurality of slots in alignment with the corresponding pin receiving holes, respectively; and a plurality of pin members each including a leading section wherein said leading section is not only retained within the corresponding slot of the pin support member but also extends through the corresponding pin receiving hole and into a space in front of the first surface, and wherein said plural slots are side by side arranged in generally a diagonally inclined member in the pin support member.

* * * * *